United States Patent [19]

Russell et al.

[11] 4,083,117

[45] Apr. 11, 1978

[54] ALL ANGLE BOREHOLE TOOL

[75] Inventors: Anthony William Russell; Michael King Russell, both of Cheltenham, England

[73] Assignee: Sperry-Sun, Inc., Sugar Land, Tex.

[21] Appl. No.: 726,199

[22] Filed: Sep. 24, 1976

[51] Int. Cl.[2] ..... G01C 9/02

[52] U.S. Cl. ..... 33/313

[58] Field of Search ..... 33/304, 312, 313; 73/510, 151

[56] References Cited

U.S. PATENT DOCUMENTS

| | | | |
|---|---|---|---|
| 3,862,499 | 1/1975 | Isham et al. | 33/312 |
| 3,913,406 | 10/1975 | Johnston | 73/517 B |

FOREIGN PATENT DOCUMENTS

| | | | |
|---|---|---|---|
| 2,523,056 | 1/1976 | Germany | 73/510 |

*Primary Examiner*—Steven L. Stephan

*Attorney, Agent, or Firm*—Macka L. Murrah

[57] ABSTRACT

Inclination and high side angle of a borehole is measured by a tool that may be positioned inside a drill string and lowered into the borehole. The tool includes three gravity transducers positioned in a novel array. The transducers are positioned in a case whose axis coincides with that of the borehole and are arranged with their axes angularly displaced from each other around the case axis by approximately 120 degrees and from the case axis by approximately 45 degrees. An array of fluxgate magnetic transducers may be added to the apparatus to provide combination surveying and steering capability.

6 Claims, 9 Drawing Figures

ALL ANGLE BOREHOLE TOOL

BACKGROUND OF THE INVENTION

The invention relates to measurement of the inclination of a borehole, and more particularly to a transducer array particularly suited therefor.

In drilling boreholes, as for the production of oil and gas, it is desirable to know the course of the hole and the position of a drilling apparatus in the hole. This information is most important in directional drilling in which a borehole is drilled to some predetermined point below the earth surface and horizontally displaced from the surface location. An important example of such directional drilling is found in drilling wells from offshore platforms. There it is a common practice to build a large drilling platform that is permanently secured to the ocean floor and from which a multiplicity of wells are drilled. Because of the number of wells that are drilled from a single platform, it is necessary to drill the holes laterally from the platform in order that earth formations containing petroleum reservoirs may be penetrated at desired locations. This procedure permits production from as great an area as possible by equipment located on a single platform.

In order to determine the course of a borehole it is necessary to know two pieces of information, the inclination of the borehole with respect to the vertical, and the azimuthal direction of the inclined hole. A common means of measuring inclination and azimuth is disclosed in U.S. Pat. No. 3,791,043. This patent discloses both a mercury pendulum switch and a resistive type strain gauge. In each instance these devices are arranged along the axes of an orthogonal coordinate system. The patent also discloses three fluxgates in a mutually perpendicular configuration for measuring components of the earth's magnetic field.

SUMMARY OF THE INVENTION

It is an object of the present invention to provide a more compact arrangement of gravity transducers in a tool for use inside a drill string. A case for a borehole device is most limited in size in its lateral dimension. Conventional transducer arrays, which are constructed with a transducer along each of the three axes of an orthogonal coordinate system having a common origin, severely limit the length of the transducers since in the conventional orientation two of the transducers are placed lengthwise across the lateral dimension. The present object is accomplished by non-orthogonal positioning of the transducers. In this arrangement three gravity transducers are positioned in a case whose axis coincides with that of the borehole, or other, axis. The transducers are positioned with their axes angularly displaced from each other around the case axis, preferably by 120°, and from the case axis more than 0° but less than 90°, preferably approximately 45°, and are stacked so as to have no common origin. This permits each transducer to utilize the less restrictive longitudinal dimension of the case.

It is a further object of the invention to provide identical gravity transducers. This object is accomplished by constructing the transducers in elongated frames that may be stacked end to end. The only difference between the transducers is the order in which they are stacked and in the angular displacement between the transducer axes around the common axis of the frames.

Still a further object of the invention is to provide a gravity transducer array in which all transducers are uniformly subject to shock along the longitudinal axis of the case. This object is accomplished by the above arrangement which orients the transducers generally in the same relationship to the longitudinal axis of the case. Since most shock in drilling is applied vertically along the drill string, all transducers receive shock from the same direction. This is in marked contrast to the orthogonal arrangement in which the longitudinally-positioned transducer would receive shock from a different direction from the two laterally-positioned transducers.

It is still a further object of the invention to provide a gravity transducer array that is convenient to manufacture and to repair. This object is accomplished by providing that each of three transducers is positioned in three individual frames that are stacked one atop the other and connected together, preferably by location pins, to prevent rotation with respect to each other about the longitudinal axis. This permits identical transducers and frames therefore to be separately manufactured and simply stacked. This is in contrast to previous transducer arrays in which all three transducers, which are by nature extremely small, were manufactured as a single unit. The difficulty of manufacturing and repairing such previous transducers is apparent.

It is another object of the invention to provide a borehole tool having surveying and steering capability. This is accomplished by adding an array of three magnetic field sensors to the gravity transducer array to provide azimuth information.

BRIEF DESCRIPTION OF THE DRAWINGS

The invention may be more fully understood from the following detailed description of one embodiment thereof when taken in conjunction with the drawings, wherein.

DESCRIPTION OF THE PREFERRED EMBODIMENT

Figure 1:
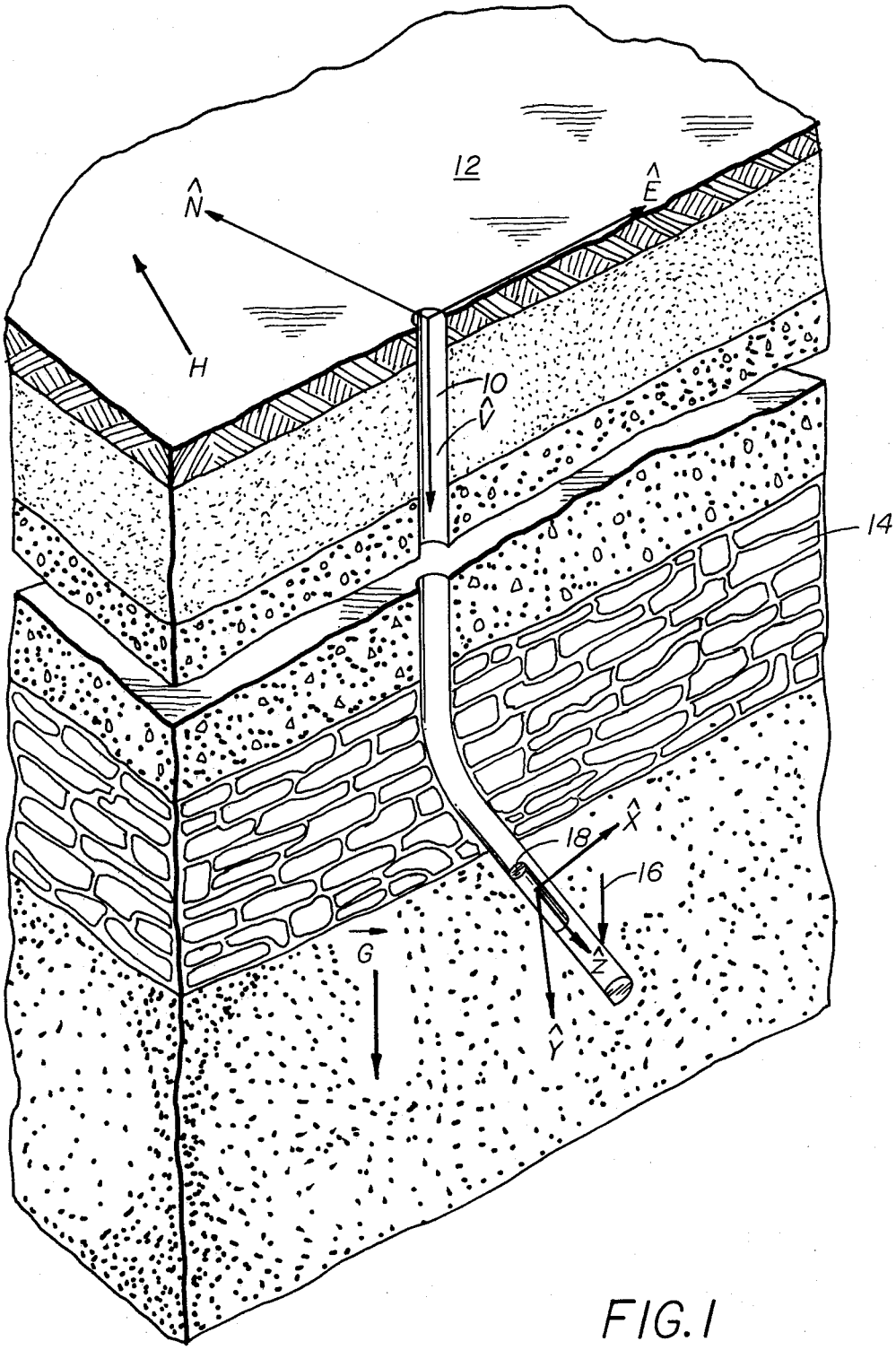
FIG. 1 is a cross section of a typical directionally drilled borehole showing earth and instrument reference axes.

Referring to FIG. 1, a typical embodiment in which the invention may be used is shown. A borehole 10 commences at the earth's surface 12 and traverses subsurface formations 14. The borehole may begin vertical, but for a variety of reasons, both intentional and accidental, the hole may vary from the vertical direction. When the hole deviates from the vertical, there is a topmost side 16 known as the high side.

The borehole may be referenced to a rectangular coordinate system as follows: $\hat{N}$ defined by a horizontal line directed from the center of the borehole toward magnetic north; $\hat{E}$ defined by a horizontal line to magnetic east; and $\hat{V}$ defined by a line directed vertically downward. These may be called earth axes.

The invention may be embodied in an angle measuring tool 18 that may be positioned in the bottom of the borehole with its axis coinciding with the axis of the borehole. The instrument attitude may be referenced to a rectangular coordinate system having axes as follows: $\hat{x}$ perpendicular to the instrument axis and in the direction of some predetermined point on tool 18; $\hat{y}$ perpendicular to the instrument axis and the $\hat{x}$-axis; and $\hat{z}$ in the downward direction along the instrument axis. These may be called instrument axes. The invention is constructed to measure components of the earth's gravity vector G and magnetic vector H.

The central idea of remote attitude sensing is to measure three non-coplanar components of the earth's gravity and magnetic fields with transducers that are in some known fixed relationship to tool 18 and by well-known trigonometric techniques to relate the attitude of the tool to the earth axes. From these calculations three parameters or angles are derived: $\theta$, the inclination angle, which is the angle between the vertical $\hat{V}$ and the longitudinal instrument axis $\hat{z}$; $\phi$, the high side angle, which is the angle between lateral axis $\hat{x}$ and the high side 16 of the borehole; and $\psi$, the azimuth angle, which is the angle between the $\hat{z}$ instrument axis and the $\hat{N}$ earth axis when the $\hat{z}$ axis is projected into the $\hat{N}$-$\hat{E}$ plane.

Figure 2:
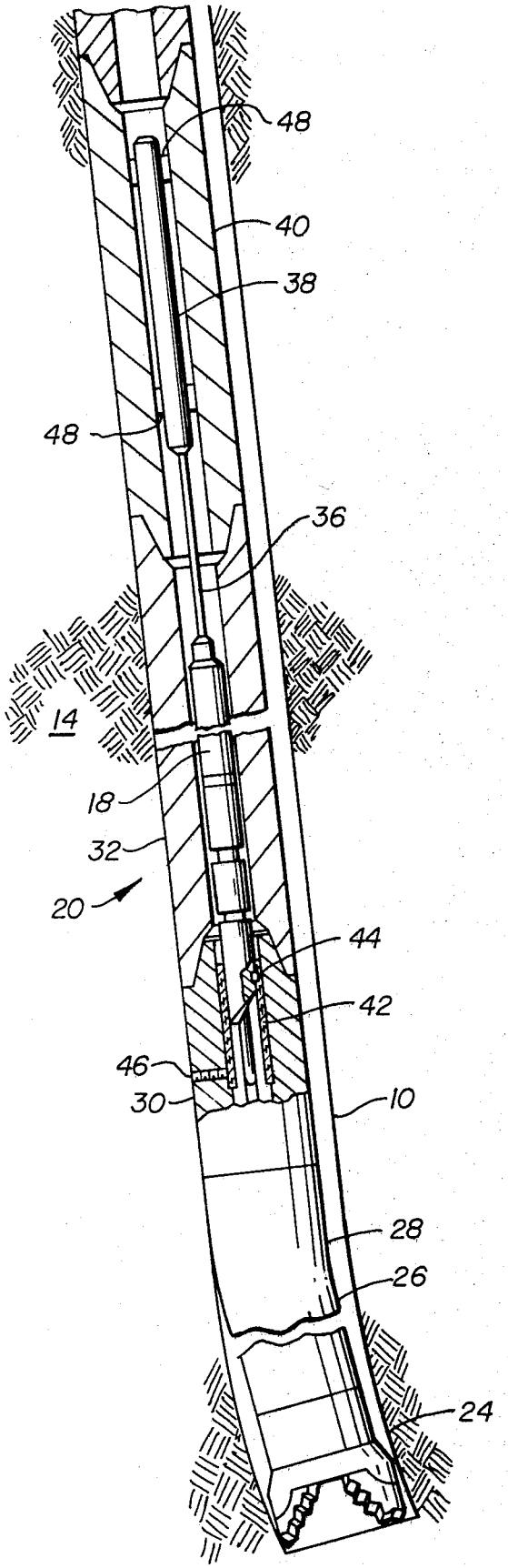
FIG. 2 is a cross section of a directional drilling apparatus that includes inclination sensing means.

Referring to FIG. 2, the angle measuring tool 18 may be positioned in the lower end of a drill string 20 in the borehole 10. The drill stem includes a rotatable drill bit sub 24 positioned below a mud motor 26 in a bent sub. The particular drilling system shown is operated by a hydraulic mud motor apparatus in which only the drill bit rotates rather than the entire drill string rotating as in a rotary drilling system. In the mud motor system, the drill bit is rotated by movement of pressurized mud, which is injected into the drill string 20 at the surface, through mud motor 26.

Bent sub 28 is used to perform directional drilling. The direction of the borehole 10 can be changed by rotating drill stem 20 to reestablish the plane in which bent sub 28 points.

Above bent sub 28, the drill stem includes a muleshoe orienting sub 30, and a drill collar 32. An angle measuring tool 18 is positioned within the interior bore of the drill collar 32 and is connected to a conductor cable 36 at its upper end. The conductor cable carries signals generated in tool 18 either to the surface or to an acoustical transmitter tool 38, or the like, in a transmitter sub 40, which is positioned above drill collar 32. The remainder of drill stem 20 above transmitter sub 40 may be made up of conventional drill pipe sections.

Muleshoe orienting sub 30 includes a muleshoe sleeve 42 positioned within its interior bore in a predetermined orientation. Sleeve 42 is held in the predetermined orientation with the sub by means of a screw 46, or the like, extending through the sidewall of sub 30. Muleshoe sleeve 42 has a key 44 positioned in its sidewall and extending inwardly into its interior bore. The muleshoe sleeve and its key are normally aligned with respect to the deflection plane of the bent sub. This predetermined alignment of the muleshoe key with respect to the deflection plane of the bent sub is convenient for purposes of determining the position of the drill bit with respect to the surface indications of hole deflection and providing compensating changes therein, although other alignment techniques could also be used. Muleshoe sleeve 42 has longitudinal slots (not shown) formed therein which provide a mud circulating bypass through the sleeve when a tool is positioned therein.

Acoustical transmitter 38 is secured in transmitter sub 40 by webs 48. An electro-acoustical transducer inside transmitter 38 (not shown) generates acoustical signals in response to signals generated in angle measuring tool 18. The acoustical signals are coupled into sub 40 of drill stem 20 through webs 48, and they travel along the drill stem to the surface where they are received and interpreted. For deep holes acoustical repeaters may be placed at periodic intervals along the drill stem to compensate for attenuation of the signals.

Figure 3A:
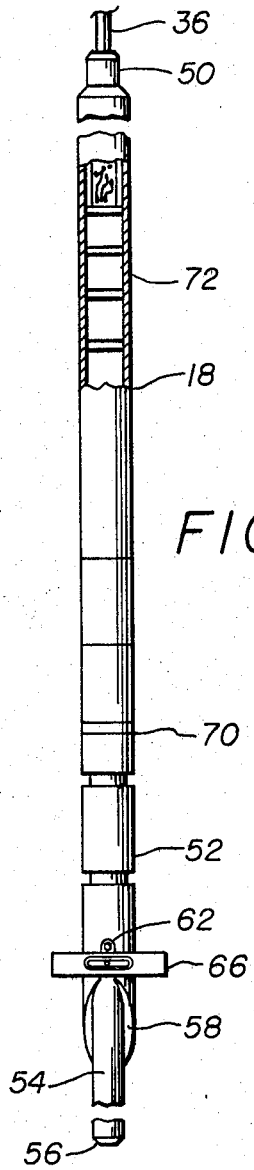
FIGS. 3A and 3B are views of the inclination sensing apparatus shown in FIG. 2.
Figure 3B:
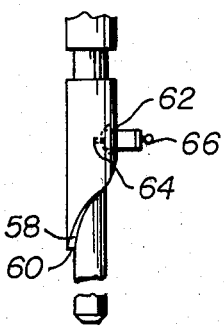

Referring to FIGS. 3A and 3B, angle measuring tool 18 is connected by an adapter 50 to conductor cable 36. A muleshoe 52 is secured to the lower end of the tool string. The muleshoe includes a protruding shaft 54 having a tapered end 56 for guiding shaft 54 into muleshoe sleeve 42 (FIG. 2). A beveled shoulder 58 extends around opposite sides of protruding portion 54 meeting at a pointed terminal 60. On the opposite side of the tool, the beveled portions 58 meet to form a longitudinally extending slot 62. Slot 62 is sized to receive inwardly extending key 44 (FIG. 2) on the muleshoe sleeve 42 when the tool is positioned in the drill pipe. As shown in FIG. 3A a hole 64 extends downwardly in the slot toward the center of the tool. Hole 64 is arranged to receive a leveling device 66 which has a pin depending therefrom for insertion into the hole.

The angle sensing tool includes a muleshoe adjuster which permits rotation of muleshoe 52 relative to tool string 18. The adjuster includes mating portions, or a T-slot connector (FIG. 4), between muleshoe 52 and toolstring 18 to prevent relative rotation therebetween. It also includes a locking collar 70 for securing tool string 18 and muleshoe 52 in a fixed position.

Figure 4:
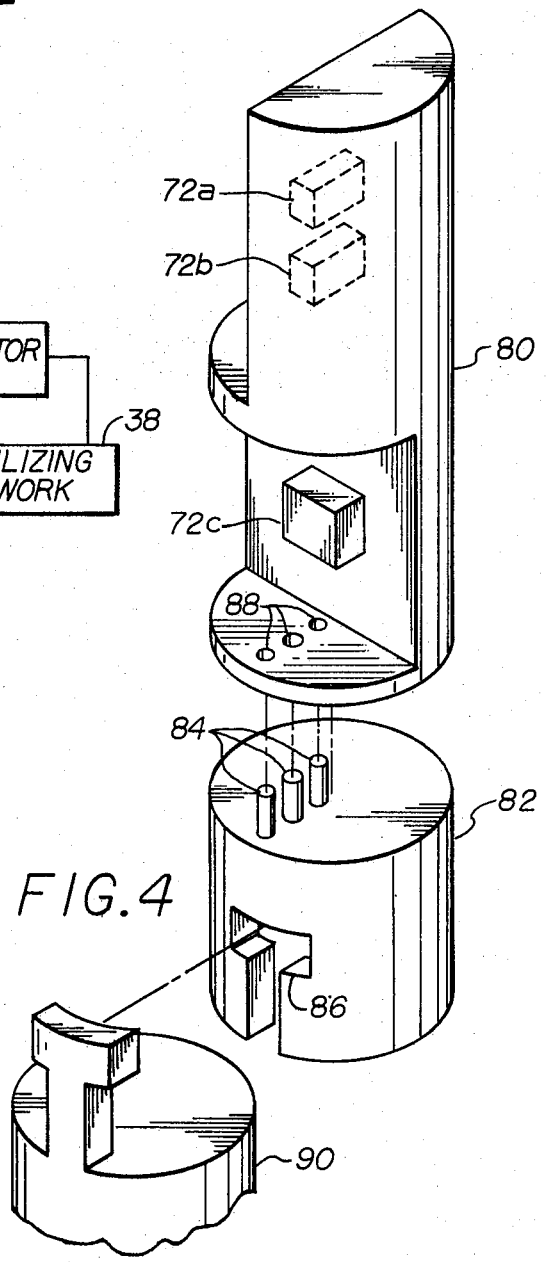
FIG. 4 shows a T-slot connector used in connection with the inclination sensing tool of FIGS. 3A and 3B.

Referring to FIG. 4, the inclination transducer may be positioned in a case preferably cylindrical, attached atop a chassis 80, or the like, and inserted into tool string 18. The chassis may be secured in a predetermined orientation with respect to tool string 18 by means of a "T-slot" arrangement as shown in FIG. 4. The lower end of chassis 80 may be positioned upon a female portion 82 of a T-slot connector by means of indexing dowels 84, which fit into indexing holes 88 on chassis 80. Female connector portion 82 has a slot 86 in the form of the letter "T." The slot receives a T-shaped insert when a male portion 90 of the T-slot connection, is positioned above muleshoe 52. Chassis 80 may have attached thereto fluxgates 72a, 72b and 72c in a non-coplanar configuration to provide azimuthal information necessary to provide combination surveying and steering capability.

Figure 5B:
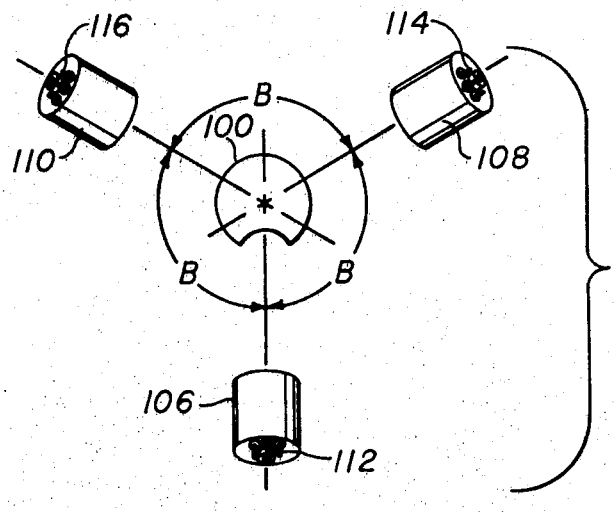
FIG. 5B is the top view of the exploded view of FIG. 5A.
Figure 5A:
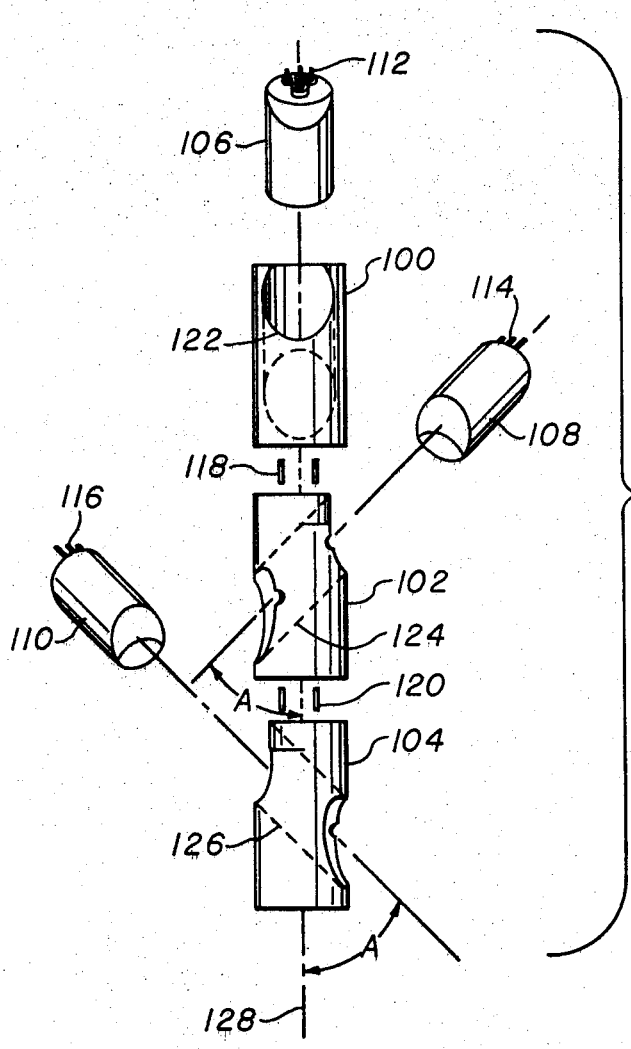
FIG. 5A is an exploded view of the transducer arrangement to which the present invention pertains.

Referring to FIG. 5A, the transducer array of the present invention is shown in detail. The array comprises three transducers 106, 108 and 110 that are positioned in slots 122, 124 and 126 in frames 100, 102 and 104, respectively. The three frames are attached one atop the other and connected by means of pins 118 and 120. It is apparent from the figure that the frames are angularly displaced from each other about their common axis, which displacement will be discussed in connection with FIG. 5B. Such displacement permits slots 122, 124 and 126 and, consequently transducers 106, 108 and 110 to be oriented in different directions. In addition to lateral angular displacement, the axes of the transducers, and therefore those of the slots, are each angularly displaced from the common axis 128 of the frames by an angle A, which is preferably 45°. This angle of 45° minimizes the horizontal space required for a transducer, making for a more compact arrangement, while still maintaining sufficient sensitivity along frame axis 128. It should also be noted that all the transducers and the frames in which they are carried are identical. The only difference is in the positioning of pins 118 and 120 such that each transducer is angularly displaced from the other around axis 128. Identical transducers increase the convenience of manufacture as is apparent. The enclosure of each of the three transducers in separate frames that are stacked end to end also permits convenient assembly and disassembly, thereby decreasing manufacture and repair time.

Referring to FIG. 5B, the top view of the transducer arrangement of FIG. 5A is shown. Transducers 106, 108 and 110 are shown with electrical connections 112, 114 and 116 for transmitting information out of the transducers and to circuitry for computation of inclination. As previously mentioned, the axes of the three transducers are displaced from each other by angles B. Angles B are preferably equal and are preferably 120° each.

Figure 6:
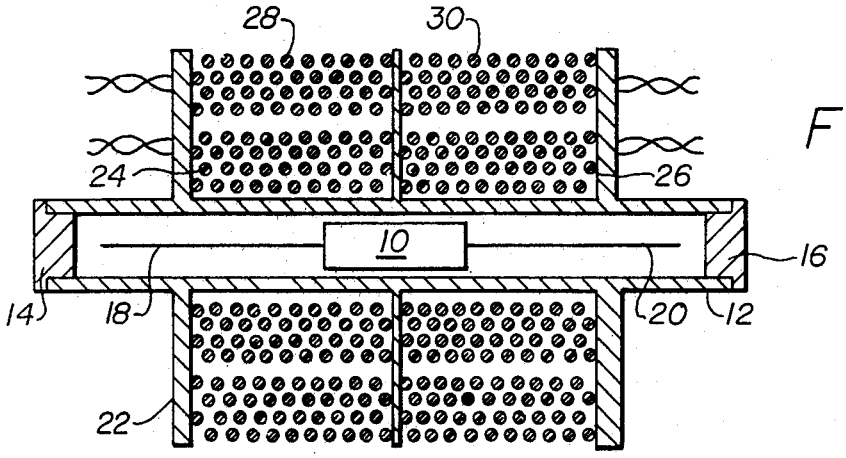
FIG. 6 is a cross sectional view of the sensor of a gravity transducer, or accelerometer, that may be used in connection with the invention.

Referring to FIG. 6, a sensor for an accelerometer has a proof mass comprising a cylindrical bar magnet 10 positioned within a cylindrical tube 12 which has its ends closed by respective stoppers 14 and 16 and is filled with magnetic fluid comprising an oil having particles of magnetic material suspended thereon. Because of the nature of the fluid, the magnet 10 is suspended within the fluid away from the sides of the tube 12 with its longitudinal axis parallel to that of the bore. Respective rods or straight wires 18 and 20 project axially from each end of the bar magnet 10. The overall length of the bar magnet 10 and the two rods or wires 18 and 20 is a little less than the internal length of the tube 12. Thus the rods or wires act as end stops, engaging with the stoppers 14 and 16 if the displacement of the magnet becomes excessive.

The outer surface of the tube 12 forms the spindle of a bobbin 22 having two axially spaced sections each of which contains two coils. The radially inner coils 24 and 26 are forcing coils and the radially outer coils 28 and 30 are sensing coils.

Figure 7:
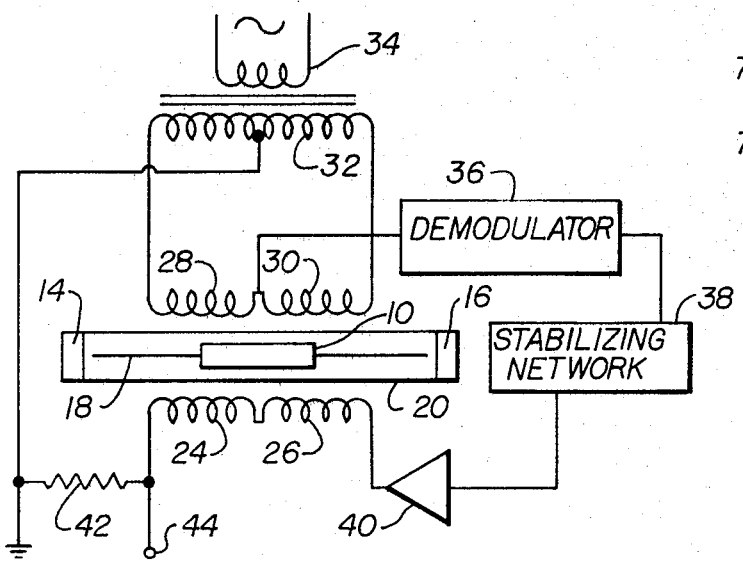
FIG. 7 is a diagram of an electrical circuit for use with the transducer, or sensor, of FIG. 6.

Referring to FIG. 7, the sensing coils 28 and 30 are connected to form two of the arms of an inductance bridge, the other two arms being formed by the center tapped secondary 32 of a transformer which has its primary 34 connected to a 1 kHz alternating current supply. The inductance bridge produces an out-of-balance voltage if the magnet 10 is not symmetrically disposed with respect to the sensing coils. This voltage is applied to a demodulator 36 to provide a direct current output proportional thereto. The output of the demodulator is applied via a stabilizing network 38, which may take the form of a low-pass filter, and a high-gain amplifier 40 to the forcing coils 24 and 26 which are connected in series with a resistance 42 and wound in such a way that their axial fields are in opposition. The direction of the current applied to the forcing coils 24 and 26 is such that the bar magnet 10 is driven towards the bridge null position in which it is symmetrically disposed with respect to the two sensing coils 28 and 30. The potential difference across the resistance 42 is measured at a terminal 44. Since the axial balancing force on the magnet 10 is proportional to the current through the forcing coils 24 and 26, the voltage on the terminal 44 is proportional to the external axial balancing force acting on the magnet 10.

Since the sensing current is an alternating current and the forcing current is a direct current, it is possible to use common coils to perform both the function of the sensing coils and that of the forcing coils.

With the suspension of the proof mass as described, static resistance to movement thereof is very small while at the same time, the viscous drag resistance is large. Careful winding and matching of the sensing coils enables the sensed null position to be made coincident with the physical center of the bore. The proof mass spring constant at this position is very small.

While particular embodiments of the invention have been shown and described, it is apparent that changes and modifications may be made without departing from the true scope and spirit of the invention. It is therefore the intention in the appended claims to cover all such changes and modifications.

What is claimed is:

1. An apparatus for measuring the inclination and high side angle of a borehole, comprising:

a cylindrical case for positioning in the borehole;

a first cylindrical frame longitudinally positioned in said case and having a bore through the side thereof;

a first gravity transducer positioned in the bore of said first frame;

a second cylindrical frame longitudinally positioned in said case atop said first frame and having a bore through the side thereof, said second frame being rotated about its elongate axis such that the axis of the bore is displaced from the axis of the bore in said first frame;

a second gravity transducer positioned in the bore of said second frame;

a third cylindrical frame longitudinally positioned in said case atop said second frame and having a bore through the side thereof, said third frame being rotated about its elongate axis such that the axis of the bore is displaced from the axes of the bores in said first and second frames;

a third gravity transducer positioned in the bore of said third frame; and means for holding each of said frames in fixed relationship to each other.

2. An apparatus for measuring the inclination and high side angle of a borehole in accordance with claim 1 wherein the axis of each of said bores in said frames is angularly displaced from the elongate axis of said frame by 45°.

3. An apparatus for measuring the inclination and high side angle of a borehole in accordance with claim 1 wherein the axis of each of said bores in said frames is displaced around the elongate axes of said frames from each other bore by 120°.

4. An apparatus for measuring the inclination and high side angle of a borehole, comprising:

a cylindrical case for positioning in the borehole;

a first cylindrical frame longitudinally positioned in said case and having a bore through the side thereof at an angle of substantially 45° from the elongate axis of said first frame;

a first gravity transducer positioned in the bore of said first frame;

a second cylindrical frame longidutinally positioned in said case atop said first frame and having a bore through the side thereof at an angle of substantially 45° from the elongate axis of said second frame, said second frame being rotated about its elongate axis such that the axis of the bore is displaced from the axis of the bore in said first frame by substantially 120°;

a second gravity transducer positioned in the bore of said second frame;

a third cylindrical frame longitudinally positioned in said case atop said second frame and having a bore through the side thereof at an angle of substantially 45° from the elongate axis of said third frame, said third frame being rotated about its elongate axis such that the axis of the bore is displaced from the axis of the bore in said second frame by substantially 120°;

a third gravity transducer positioned in the bore of said third frame; and means for holding said first, second, and third cylindrical frames in a fixed position relative to each other.

5. An apparatus for measuring the inclination and high side angle of a borehole in accordance with claim 4 wherein said holding means comprises a multiplicity of pins positioned in conforming bores in and between said first, second, and third frames.

6. A transducer array for use in a borehole instrument, comprising:

three cylindrical frames stacked atop each other, each of said frames having a bore through the side thereof at substantially 45° from the elongate axis of said frames, said bores being displaced from each other about the elongate axis of said frames by substantially 120°;

a gravity transducer in each bore; and means for holding said frames in a fixed positional relationship.

* * * * *